United States Patent [19]

Bergmann et al.

[11] Patent Number: 4,967,566

[45] Date of Patent: Nov. 6, 1990

[54] PROCESS AND APPARATUS TO IMPROVE THE POWER FACTOR OF COMPRESSOR-OPERATED (HYBRID) REFRIGERATORS OR HEAT PUMPS FUNCTIONING WITH SOLUTION CYCLE

[75] Inventors: György Bergmann; Géza Hivessy, both of Budapest, Hungary

[73] Assignee: Energiagazdalkodasi Intezet, Budapest, Hungary

[21] Appl. No.: 52,540

[22] Filed: May 21, 1987

[30] Foreign Application Priority Data

May 23, 1986 [HU] Hungary ..... 2182/86

[51] Int. Cl.[5] ..... F25B 15/00

[52] U.S. Cl. ..... 62/101; 62/115; 62/114; 62/335; 62/476; 62/502

[58] Field of Search ..... 62/114, 498, 502, 115, 62/101, 335, 476

[56] References Cited

U.S. PATENT DOCUMENTS

| | | | |
|---|---|---|---|
| 3,698,202 | 10/1972 | Missimer | 62/114 |
| 3,733,845 | 5/1973 | Lieberman | 62/114 X |
| 3,872,682 | 3/1975 | Shook | 62/114 |
| 4,014,181 | 3/1977 | Burger | 62/114 |
| 4,481,783 | 11/1984 | Pecz et al. | 62/115 X |
| 4,495,776 | 1/1985 | Nikolsky et al. | 62/114 |
| 4,688,397 | 8/1987 | Bakay et al. | 62/502 X |

*Primary Examiner*—Lloyd L. King

*Attorney, Agent, or Firm*—Schweitzer Cornman & Gross

[57] ABSTRACT

A process for the operation of hybrid compression-absorption heat pumps or refrigerators with the use of fluid medium containing a mixture of differently volatile components (typically two) easily soluble in each other. During heat extraction, in a first counter current heat exchange, vapor of the more volatile component is partially dissolved in the liquid of the less volatile component. Simultaneously, an additional portion of the volatile component is condensed. Importantly, the medium is discharged from the first heat exchange in a stage of incomplete dissolution/condensation of the vapor phase. The combined medium is expanded and absorbs heat in a second counter current heat exchange phase, during which the more volatile component is both expelled from the solution and evaporated. A counter current heat exchanger is connected between the first and second heat exchangers, and uses low pressure medium exiting from the second heat exchange to effect cooling and thus further dissolution and condensation of the high pressure medium exiting from the first heat exchange.

7 Claims, 5 Drawing Sheets

Figure 1:
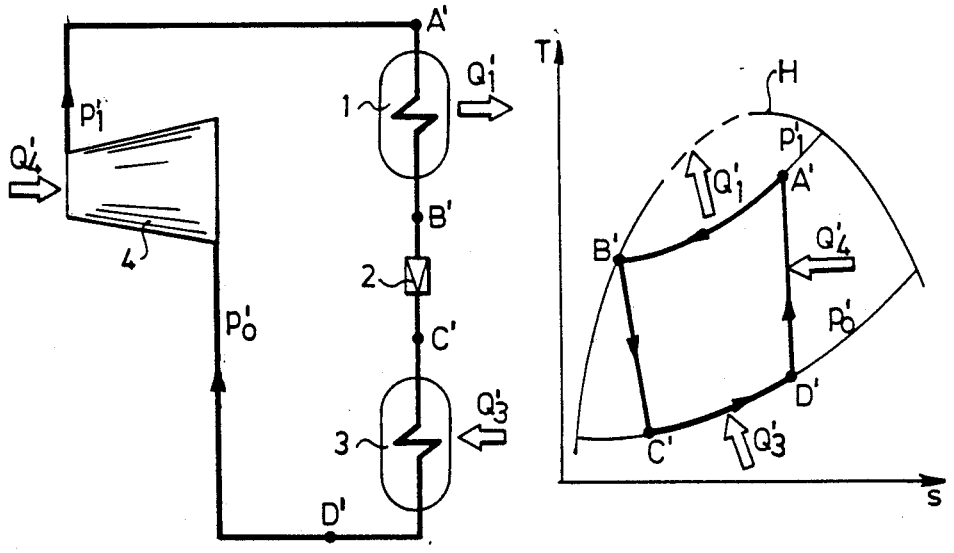

PROCESS AND APPARATUS TO IMPROVE THE POWER FACTOR OF COMPRESSOR-OPERATED (HYBRID) REFRIGERATORS OR HEAT PUMPS FUNCTIONING WITH SOLUTION CYCLE

The invention relates to a process and apparatus to improve the power factor of compressor-operated (hybrid) refrigerators or heat pumps, where the medium is carried by compressor and this medium is the mixture of two differently volatile components well soluble in each other. (Hybrid compression-absorption cycle).

As known, the power factor of compressor cycles functioning with solution may be considerably higher in certain cases (varying temperature of the heat source and heat receiver), than the compressor cycles using homogeneous medium, hence their application in such cases is economical. Another advantage of the cycles functioning with solution is that a much wider temperature range can be bridged over in a single stage.

Such cycle functioning with solution is described in the EPO patent No. 0021205, where the total working medium (e.g. vapour and liquid) moves together in all stages of the cycle. Hence the compressor absorbs and emits wet vapour, i.e. it realizes wet compression. Heat exchange takes place between the high pressure liquid emerging from the condenser and the high pressure vapour emerging from the evaporator. The drawback of the method is that the rate of internal heat exchange is restricted by entry of the already condensed medium into the heat exchanger on the high pressure side.

According to a further known method—the further-development of which is the above quoted EPO patent No. 0021205—the so-called Osenbrück method, only the liquid phase of the working medium is admitted into the internal heat exchanger after the evaporator. This way the benefits offered by the internal heat exchanger can be utilized even to a lesser degree.

As know, in compression within given pressure limits, the intermediate recooling of the medium reduces the compression work. The recooling is generally carried out between compressor stages, or in concrete case evaporating liquid (e.g. water) is injected into the compressor. The wet compression according to the quoted EPO patent No. 0021205 is based on similar considerations, which improves the power factor by recooling the medium.

The invention is aimed at the further-development of the known methods, and improving the power factor of refrigerators or heat pumps.

The novelty of the process and apparatus according to the invention is based on the recognition, that during the heat exchange taking place in the internal heat exchanger—increasing the amount of heat transferred—the pressure ratio of the compression is reduced, and thereby the power factor of the apparatus is improved. (Value of the effective heat per unit mechanical work.)

The known heat pumps and refrigerators according to above recognition can be further developed in compliance with the invention, in that the medium of wet vapour is discharged from the condenser-absorber still before completion of the condensation and dissolution, and admitted into a vapour-cooling internal heat exchanger, where the condensation and dissolution are completed. The so-released heat is used for further heating of the vapour emerging from the liquid-cooling internal heat exchanger on the low pressure side.

In order to realize the wet compression, the liquid phase of the medium in wet vapour state is separated in part or in its totality e.g. at least partly before the compressor, and reatomized through nozzles into the medium during or in given case before or after the compression.

The process as subject of the invention is used for the operation of compression-absorption heat pumps or refrigerators, with medium consisting of two differently volatile components well soluble in each other, when in the process of the first heat exchange during heat extraction, partly the vapour of the more volatile component is dissolved in the liquid of the less volatile component (absorption), and partly the vapour of the less volatile component is condensed, then after expansion of the medium in the process of the second heat exchange during heat addition, the more volatile component is expelled at least in part from the solution, and partly the less volatile component is evaporated at least in part, then the medium is compressed.

The novelty of the process according to the invention is that the medium is discharged from the first heat exchange as the mixture of two phases (liquid and vapour) with different concentration.

The process according to the invention is also realizable by producing internal heat exchange between the two-phase medium emerging from the first heat exchange to be expanded, and the medium emerging from the second heat exchange to be compressed, in the course of which the dissolution and condensation in the medium emerging from the first heat exchange are continued. The internal heat exchange takes place in two stages, when the condensation and dissolution are completed in the first stage, thereby bringing the whole medium into liquid phase, while in the second stage this liquid is cooled further. According to another method, wet vapour is admitted into the suction pipe of the compressor, from where the liquid is separated in part or in its totality before compression, the remaining dry or slightly wet vapour is compressed, while the separated liquid is injected into the flowing vapour. The process according to the invention is also realizable by returning the separated liquid to the vapour before compression and/or under the same pressure during compression, and/or after compression.

The apparatus for realization of the process according to the invention is a hybrid heat pump or refrigerator, the circuit of the medium cycle consists of condenser-absorber, liquid-cooling internal heat exchanger, pressure reducer, evaporator-expeller, and pressure intensifier series connected in the flow direction of the medium, the outlet of the latter one is connected to the inlet of the condenser-absorber. The novelty of the hybrid heat pump or refrigerator according to the invention is that a vapour-cooling internal heat exchanger is connected between the condenser-absorber and the liquid-cooling internal heat exchanger.

The apparatus according to the invention may be constructed by connecting the liquid separator into the suction pipe of the compressor, on the outlet side of which separate vapour and liquid pipes are built in, where the vapour pipe is connected to the compressor and a pump is built into the liquid pipe.

The liquid pipe is connected with the nozzle built into the vapour pipe before compressor, and/or with the nozzles built into the compressor, and/or with the nozzles built into the vapour pipe after the compressor.

Control devices are built into the branchings of the liquid pipe connected with the nozzles.

The main advantages of the process and apparatus used for realization of the process are as follows:

the cycle functions in the temperature and pressure range of the two-component medium most favourable for the cycle;

the power factor of the heat pump can be improved, the pressure ratio of the compressor and the maximal operating pressure of the apparatus can be reduced;

the efficiency of the compressor can be improved;

the final temperature of the compression can be reduced.

The process and apparatus according to the invention are described in detail by way of example, with the aid of drawing, in which:

FIG. 1.: The simplest circuit diagram of a conventional compressor (refrigerator or heat pump) including a T-s diagram, FIG. 2.: T-s diagram of a conventional compressor functioning with solution cycle provided with internal heat exchanger, FIG. 3.: Comparison of cycles shown in FIG. 1. and 2., based on T-s diagram, to demonstrate the importance of the internal heat exchanger, FIG. 4.: Temperature run of the cycles shown in FIG. 1. and 2. in the condenser-absorber, FIG. 5.: Conventional T-i diagram of the medium showing the temperature run attainable with the circuit according to the invention, FIG. 6.: Basic circuit and T-s diagram of the compressor functioning with solution cycle according to the invention, FIG. 7.: Circuit diagram and T-s diagram of a further embodiment of the compressor functioning with solution cycle according to the invention, FIG. 8.: Run of the conventional isentropic compression of a two-component medium with intermediate recooling, FIG. 9.: Circuit diagram illustrating the wet compression of the compressor functioning with solution cycle according to the invention, FIG. 10.: Circuit diagram showing a further developed embodiment of FIG. 9., FIG. 11.: Circuit diagram showing a further development of FIG. 10.

The conventional apparatus according to EPO patent No. 0021205 functioning with solution cycle, based on its simplest circuit diagram, as well as the T-s diagram (temperature-entropy) of the schematic circuit are shown in FIG. 1. The limit curve of the medium below which the medium is present as the mixture of liquid and vapour (wet vapour), furthermore the curves of pressures $p'_0$ and $p'_1$, between which the cycle A' B' C' D' runs are shown in the diagram. The two components of the medium do not separate in the cycle (as in the absorption cycles), but the whole medium flows in all stages of the cycle mostly as the mixture of two phases, where the concentration of the components varies from point to point during the heat exchanges. This allows heat absorption and dissipation at varying temperature.

The medium of state A' and pressure $p'_1$ enters the condenser-absorber 1, where during dissipation of heat quantity $Q'_1$, the more volatile component is dissolved in the less volatile component, and the vapours of the latter one are condensed at the same time. In the course of this, the temperature of the medium drops continuously. Upon completion of the dissolution and condensation, the medium leaves the apparatus 1 in liquid state B'.

The pressure of the medium in the expansion device 2 (which theoretically may be expansion turbine, but expansion valve is used in the practice, as shown in FIG. 1.) drops from $p'_1$ to $p'_0$ and the medium enters the evaporator-expeller 3 in state C'. Here while admitting the heat quantity $Q'_3$, most part of the more volatile component is expelled from the medium. Meanwhile temperature of the medium rises continuously. Finally the medium leaves the apparatus 3 in state D', and the compressor 4 through introducing the compression work $Q'_4$, discharges the medium again under pressure $p'_1$ in state A'. In the described cycle it is advisable to use internal heat exchange between the medium of state B' and D', which allows operation of the apparatus with lower pressure ratio and lower max. pressure within the same temperature limits. The first effect improves the compressor's efficiency, and this in turn improves the power factor of the cycle. The other effect enables to solve the same problem with an apparatus of lower nominal pressure stage, thus with a cheaper apparatus.

Additional advantage is that the internal heat exchanger reduces the throttle loss of the expansion valve 2 by cooling the high pressure liquid. Accordingly the EPO patent No. 0021205 recommends the cycle ABECDF shown in FIG. 2., which runs between pressures $p_0$ and $p_1$. Here the medium of state A and pressure $p_1$ enters the condenser-absorber 1, where dissolution and condensation take place, while the heat quantity $Q_1$ is dissipated, then the medium of state B (saturated liquid) flows to the high pressure side of the internal heat exchanger 5. Here the medium dissipating the heat quantity $Q_5$ cools further, as an undercooled liquid flows to the expansion valve 2 in state E. In the latter one the pressure of the medium drops from $p_1$ to $p_0$, while part of the medium passes again into vapour phase (state C). Then the medium flows to the evaporator-expeller 3, where evaporation and expulsion go on with the apparatus of heat quantity $Q_3$. From here the medium emerges in state D and enters the internal heat exchanger 5 on the low pressure side, where it absorbs the heat quantity $Q_5$ dissipated by the high pressure medium. Meanwhile the evaporation and expulsion go on and the temperature of the medium rises further. Finally the compressor 4 raises the medium of state F again to the pressure level $p_1$ through introduction of the compression work $Q_4$.

Figure 3:
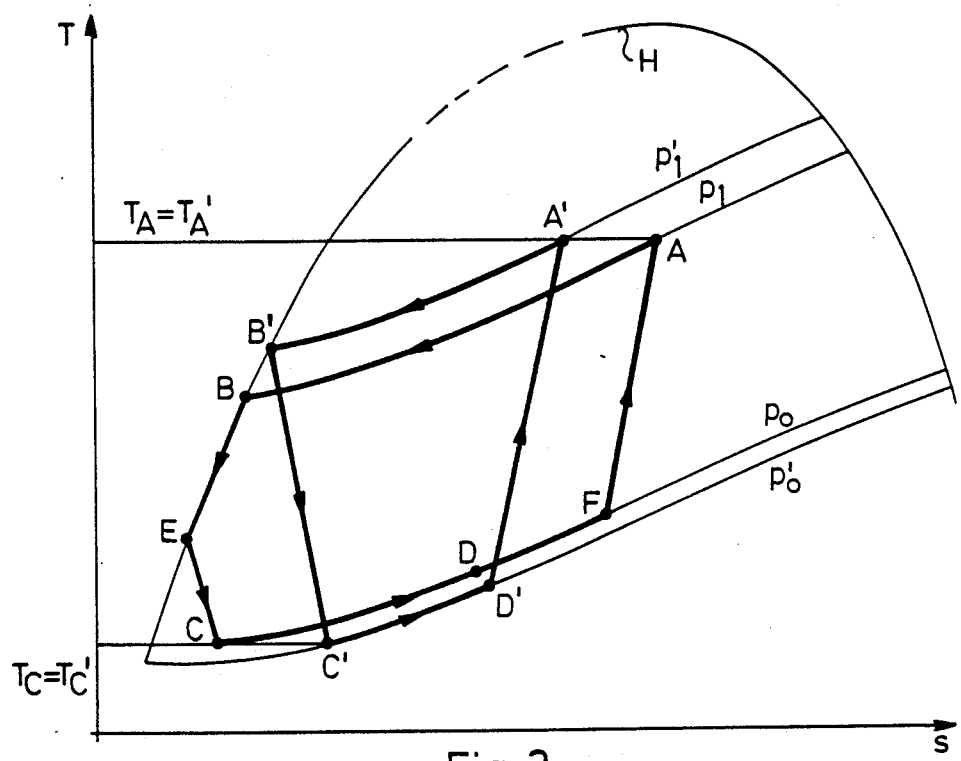

In FIG. 3., the two cycles are shown together in the T-s diagram between identical temperature limits, i.e. $T_A = T'_A$ and $T_c = T'_c$. The drawing clearly shows that under such conditions $p_1 < p'_1$ and $p_0 > p'_0$, i.e. use of the internal heat exchanger between the same temperature limits results indeed in lower pressure ratio and lower upper pressure limit ($p_1$), thus the benefits expected from the internal heat exchanger are realizable.

Figure 2:
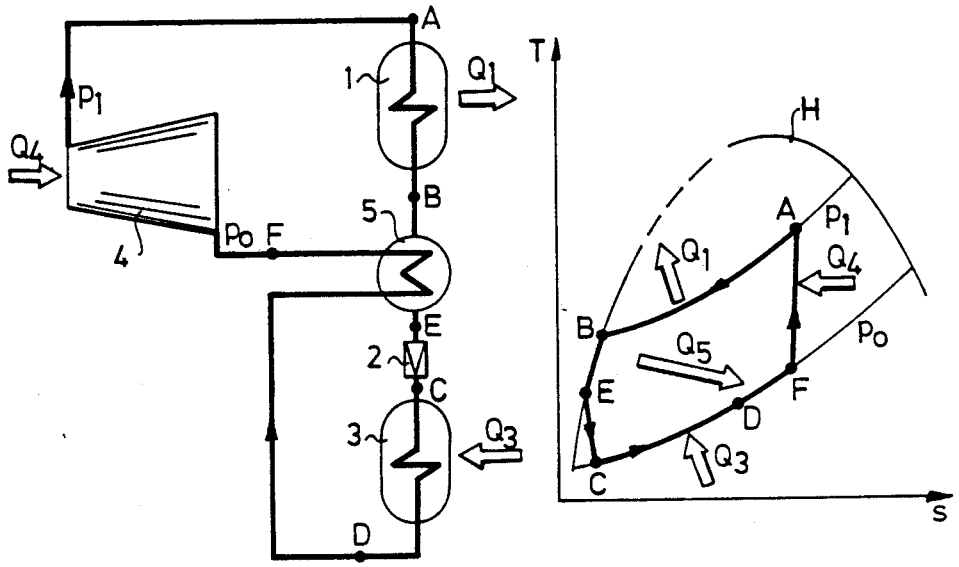

In realizing the cycle shown in FIG. 2., if the characteristics of the real media are considered, certain shortcomings are experienced.

Figure 4:
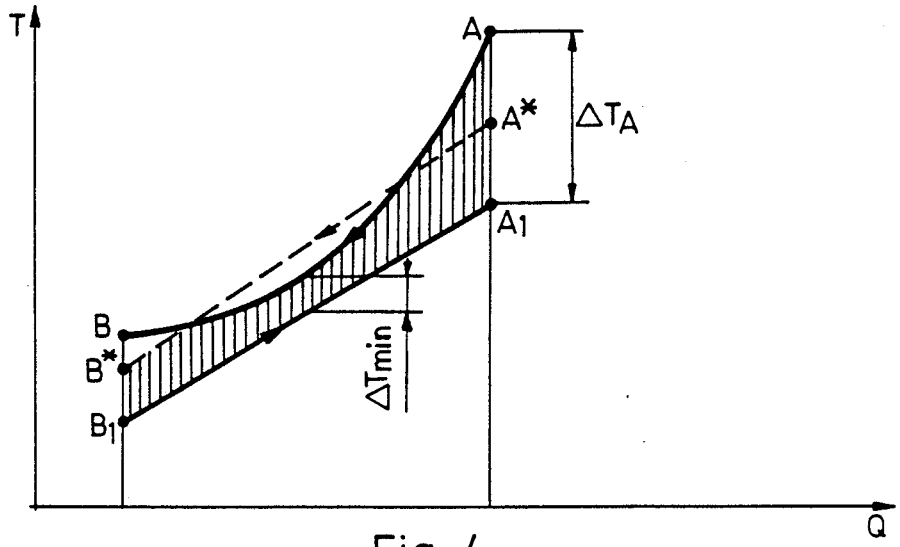

If for example the condenser-absorber of a heat pump is dimensioned, where the two-component (e.g. $NH_3+H_2O$) medium on one side passes from state A to B (liquid), while it loses the heat quantity $Q_1$, that heats the water, then the process can be illustrated in diagram T-Q (temperature—heat quantity) as shown in FIG. 4.

Here the medium passes from state A to B, while the cooling water is heated from state $B_1$ to $A_1$. Though temperature of the medium continuously drops during the process, the transferred heat is not linear function of the temperature, i.e. the curve illustrating the process is not straight line. Due to the curvature of the temperature run, the critical point of dimensioning the heat exchanger is the spot of the minimum temperature difference $\Delta T_{min}$. Since by necessity, $\Delta T_{min}>0$, the $\Delta T_a$ should be a fairly high value. Although this can be somewhat reduced by increasing the size of the heat exchanger, but because of the mentioned critical point ($\Delta T_{min}$), the result achieved even with a very large—and therefore costly—heat exchanger will be fairly poor. It is evident, that the power factor of the cycle deteriorates, as the final temperature of the compression rises. If somehow it were possible to straighten the characteristic curve of the medium, then—by selecting heat exchanger of the same size for the condenser-absorber—the temperature change of the water required between points $B_1$ and $A_1$ would states A* and B*, instead of A and B.

Figure 5:
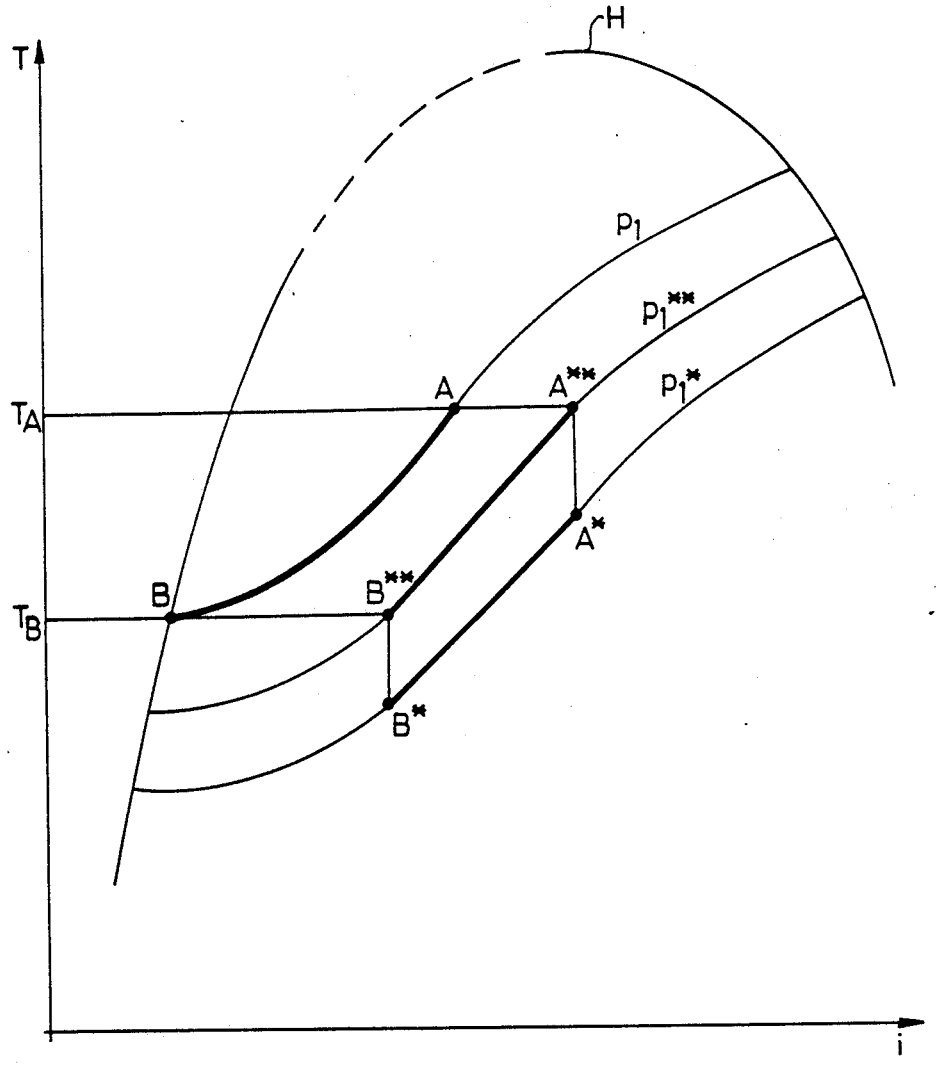

To illustrate the invention idea, the T-i (temperature-enthalpy) diagram of a two-component medium with limit curve H and curves pertaining to pressures $p_1>p_1^{**}>p_1^*$ in the field showing wet vapour states are seen in FIG. 5. Let us assume that in the cycle shown in FIG. 2., pressure $p_1$ and change of state of the medium in the condenser-absorber exist from point A to B. FIG. 5. shows that this process takes place along the most curvy section of the curve pertaining the pressure $p_1$. If it were possible to carry out this process between the same temperature limits ($T_A$ and $T_B$) under a pressure $p_1^{**}$ lower than $p_1$, then the curve section illustrating the process would be much closer to the straight line. Consequently according to FIG. 4. the temperature of the medium in the same heat exchanger (condenser-absorber) could be lower, i.e. the medium enters the apparatus in state A* and leaves it in state B*.

Thus the temperature of state A* is lower than $T_A$, and the temperature of state B* is lower than $T_B$. On the other hand, the power factor of the heat pump or refrigerator is the more favourable the lower is the temperature of the heat to be delivered (under identical other conditions). Thus if according to the invention idea, the cycle is formed as to discharge wet vapour instead of liquid from the condenser 1, so that the enthalpy change of the medium in the apparatus should approach as far as possible the linear function of the temperature, then the power factor of the heat pump or refrigerator will be higher.

Further advantage is that pressure $p_1^*$ is lower than $p_1$, which in a given case partly allows the use of cheaper apparatus as a result of the lower nominal pressure, and partly by reducing the pressure ratio it improves the efficiency of the compressor, which finally improves the power factor of the cycle.

It is noted, that in the explanation given in connection with FIG. 5., to promote better understanding, the reality was somewhat simplified. Partly in the course of changing the cycle, the enthalpy difference instead of the temperature difference between points A and B has to be kept at constant value, thus the position of points A, B and A*, B* will be slightly shifted. On the other hand in the real apparatuses, which are by necessity, forced counter-flow apparatuses, considerable pressure drop takes place during the flow, thus the pressure within the apparatus is not constant. If however, with regard to the mentioned deviations the curve 3 of FIG. 5. is plotted accurately for a real case, the final conclusion will be exactly the same as described earlier.

Figure 6:
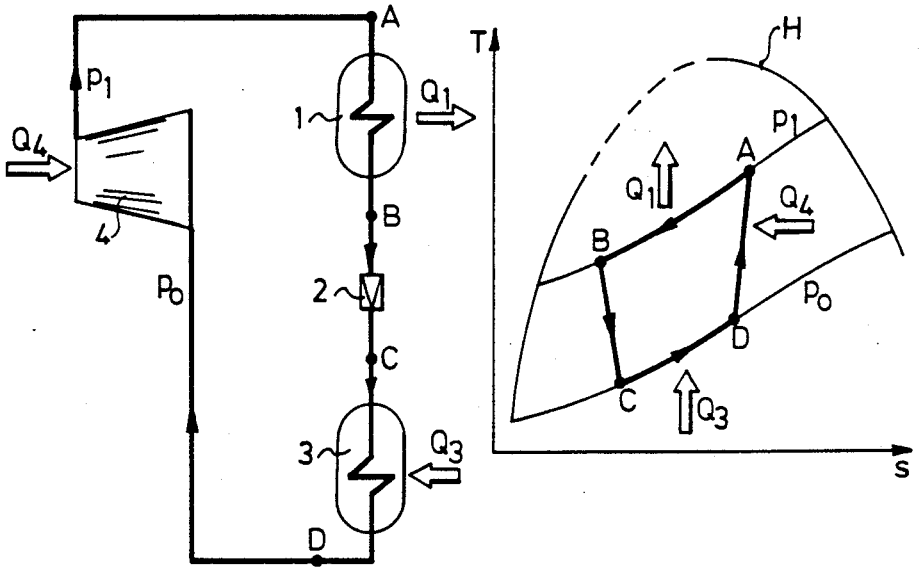

The simplest version of realizing the invention idea is shown in FIG. 6. Construction of the refrigerator or heat pump is the same as the conventional solution shown in FIG. 1., but the mode of operation is different. The most noticeable deviation is clearly seen at the cycle illustrated in the T-s diagram, namely that the point B is not on the limit curve.

A further part of the invention idea applies to the internal heat exchanger described in connection with FIG. 2. and 3. Its advantages have already been mentioned, now its limitations are pointed out. The rate of heat transferable in the internal heat exchanger is determined by the heat quantity $Q_5$ released during cooling of the liquid medium between points B and E. The point B is on the liquid side of the limit curve pertaining to pressure $p_1$, which is not variable in case of given pressure of the condenser-absorber. On the other hand, the temperature of point E is linked with point D, and cannot be lower than the temperature of point D, even in case of infinitely large and perfectly counterflow internal heat exchanger. In other words, the theoretical limit of cooling in the internal heat exchanger is $T_B-T_D$. Since the position of point D is determined by the operating conditions of the evaporator-expeller, practically there is no chance to increase further the internal heat exchange, if using the EPO patent No. 0021205 regarded as the present state of the technique. Theoretically it would be possible to increase the internal heat exchange by building up the pressure $p_1$ and/or reducing the pressure $p_o$, this however would be pointless, since the advantage of the internal heat exchanger is realized just by reducing the pressure ratio and $p_1$.

In knowledge of the invention idea, the possibility is open to increase the internal heat exchange and to reduce further the pressure ratio and pressure of the condenser-absorber, as well as to utilize the resultant advantages. If the wet vapour emerging from the condenser-absorber is admitted into an internal heat exchanger and the low pressure medium is heated with it, then just the required effect will be achieved. Moreover the transferable heat quantity is much greater than that of the internal heat exchanger 5 according to FIG. 2., where it is not the matter of cooling the liquid, but condensation and dissolution of the vapour, in which processes the enthalpy change of the medium at the given temperature change is the multiple of the enthalpy change of the liquid (the wet vapour of the two-component medium behaves during condensation and dissolution as a very large medium but of varying specific heat).

Figure 7:
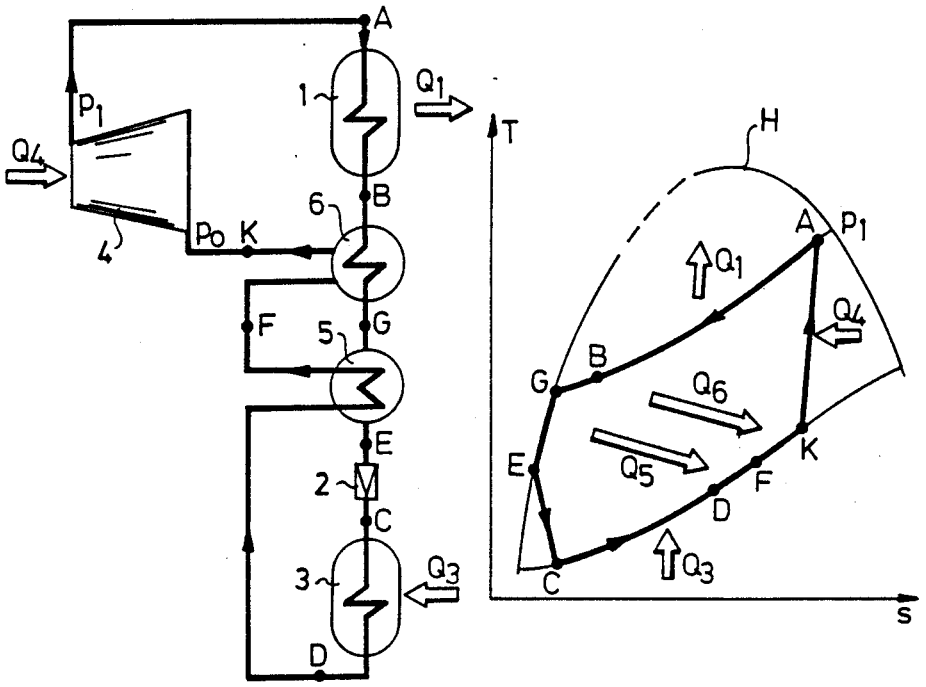

The described solution is so effective that it allows the economical bridging over 60°-80°-100° C. temperature difference in a single stage, by reducing the pressure ratio to a value acceptable for efficiency of the compressor. A realization method of the invention is shown in FIG. 7, including the circuit diagram of the machine and the T-s diagram of the theoretical cycle.

The medium of state A and pressure $p_1$ enters the condenser-absorber 1, where during dissipation of the heat quantity $Q_1$, temperature of the working medium continuously drops, while dissolution and condensation take place. However this dual process does not end here, but the wet vapour of state B leaves the apparatus and enters the vapour-cooling internal heat exchanger 6 on the high pressure side, where it cools further during dissipation of heat quantity $Q_6$, and finally the condensation and dissolution are completed. From here the medium of state G (saturated liquid) steps over to the high pressure side of the liquid-cooling internal heat exchanger 5, where it cools down to state E during dissipation of heat quantity $Q_5$. Then the medium passes into the pressure reducer 2, which is an expansion valve. Its pressure drops to $p_o$, and part of the medium assumes vapour phase (point C). The working medium enters the evaporator-expeller 3, where during absorption of heat quantity $Q_3$, the proportion of vapour phase increases and the medium is heated up. From here the medium of state D passes over to the low pressure side of the liquid-cooling internal heat exchanger 5, where it absorbs the heat quantiy $Q_5$ dissipated by the high pressure liquid, then in state F it enters the vapour-cooling internal heat exchanger on the low pressure side, where it absorbs the heat quantity $Q_6$ dissipated by the high pressure wet vapour. The preheated medium of state K is forwarded by compressor 4 again to the pressure level $p_1$ through introducing the compression work $Q_4$.

It is noted that the pressure reducing element 2 may be an expansion machine (e.g. turbine) too. This changes the cycle shown in FIG. 7., in that expansion work $Q_2$ in the element 2 is withdrawn from the medium, and so work is performed instead of choking. This solution improves the power factor of the heat pump, but it is costly. Its use can be decided from time to time on the basis of economic calculation.

Figure 8:
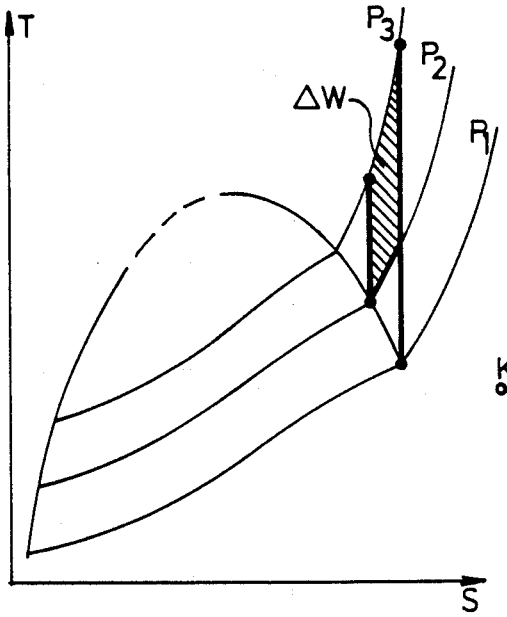

FIG. 8 illustrates the isentropic compression of the overheated vapour of a two-component medium in F-s diagram on pressure level $p_2$ with single-stage intermediate recooling between pressure limits $p_1$ and $p_2$. The hached area ($\Delta W$) represents the benefit of recooling, i.e. decrease of the compression work.

The wet compression means recooling of theoretically infinite number of stages, thus it reduces considerably the rewquired work of the cycle. However, this beneficial effect prevails only to such extent, as the liquid is capable to follow the changes of state of the vapour in the compressor. Volume of the vapour phase is reduced during compression, hence the vapour phase becomes heated up, on the other hand temperature of the liquid phase hardly varies because of the growing pressure. The much hotter vapour phase heats the liquid, which however does not become balanced with the vapour phase unitl the end of the compression.

For the mentioned reasons, the benefits expected from the wet compression are realized only to a very limited degree, if the requirement is limited merely to have two phases flowing together in the suction pipe of the compressor.

The invention recommends solution for this problem.

Since the medium stays in the compressor only for a very short time, temperature of the liquid and vapour phase can be close to each other only if sufficiently large surface is available for the heat transfer. From this it follows, that the liquid should be admitted into the vapour flow in the form of fine drops.

Figure 9:
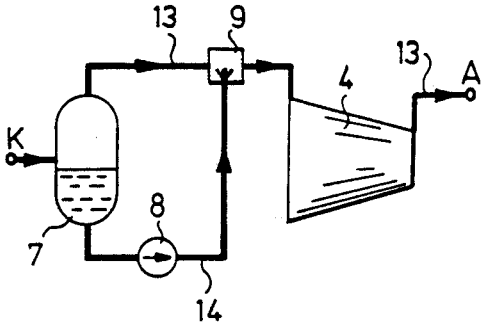

A possible embodiment of the solution according to the invention is shown in FIG. 9. Here in the pipe before the compressor, the liquid separator 7 separates the liquid phase partly or wholly, i.e. at least partly the vapour in the vapour pipe 13 moves on towards the compressor, while the pump 8 atomizes the separated liquid through the liquid pipe 14 and nozzles 9 into the vapour flow.

The piston compressors are less suitable for the realization of wet compression due to the risk of luquid knock. Consequently mainly the use of rotary compressors and within these screw compressors are recommended. On the other hand the fast rotating elements of the compressor throw the liquid—admitted into the gas flow—to the wall of the compressor house, thus the large liquid surface produced with fine atomization will be considerably diminshed.

Figure 10:
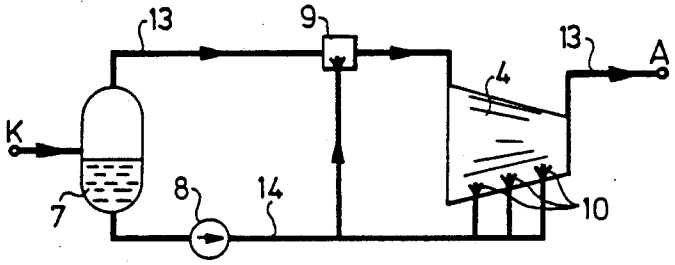

For solving above problem, the circuit shown in FIG. 10 is recommended, which represents improvement compared with the one shown in FIG. 9. Here the liquid delivered by the pump is atomized into the vapour flow through nozzles 10 not only before but partly during compression. The nozzles 10 can be built into the compressor house, or even into the holes of the shaft of the rotary part. In the latter case the atomization is assisted by the centrifugal force too. The nozzles 10 inject the liquid into the vapour on one or several pressure levels of the compression, obviously, optimal is if the liquid is injected approximately at uniform rate during compression, i.e. the nozzles are densely arranged along the length of the compressor. This depends on the compressor's construction. In certain cases the nozzle 9 may be dispensed with.

A further problem of realizing wet compression is that the delivered medium flows back through the inner gaps of the compressor, from the high pressure side to the low pressure side. This exists at dry compression too, but in case of wet compression the situation is aggravated in that first of all the liquid thrown to the wall seeps back through the gaps. This liquid evaporates upon pressure drop, whereby its volume occupied with it increases considerably, which reduces the volume of the medium sucked in by the compressor. This way the evaporating liquid may substantially increase the volumetric loss of the compressor.

Figure 11:
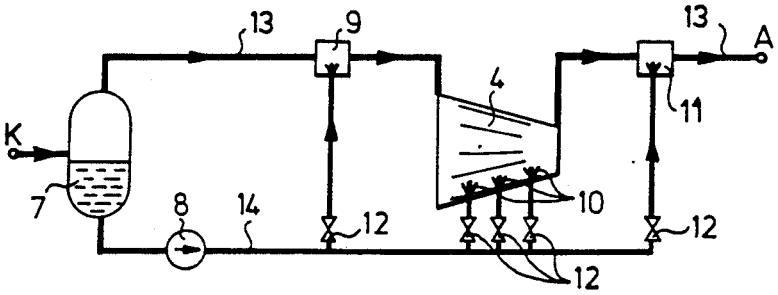

The invention presents solution to this problem too, as shown in FIG. 11.

Utilization of the benefits of wet compression is possible by returning the liquid into the vapour flow before and during compression (as in FIG. 10.), but the liquid quantity that no longer improves but deteriorates the compressor's efficiency, is delivered by pump 8—by passing the compressor—through nozzles 11 into the pressure pipe of the compressor.

It is advisable to build in control devices 12 into the branchings of the pressure pipe of pump 8 leading to each nozzle or group of nozzles. Distribution of the liquid quantity between the inlets can be regulated by adjustment of the control devices. This is carried out according to the existing operating conditions; some nozzles may be excluded.

The existence of at least one of the nozzles or group of nozzles 9, 10 and 11 is regarded as realization of the invention, irrespective of in which stage of the compression (before or after) is the liquid—separated before the compressor—returned into the gas flow.

What we claim is:

1. A process for the operation of hybrid compression-absorption heat pumps or refrigerators, wherein there is circulated in a closed circuit a refrigerant medium comprising a plurality of differently volatile components dissolvable in each other and including the steps, in sequence, of compressing the refrigerant medium, passing the high pressure medium through a first external heat exchange, in which heat is extracted from the high pressure medium, thereafter causing expansion of the medium to lower pressure and conducting the expanded medium through a second external heat exchange in which heat is added to the medium, and returning the low pressure medium for compression, the improvement characterized by (a) so controlling and conducting the first heat exchange as to limit the condensation and dissolution of the high pressure multiple component medium so as to cause said medium to exit said first heat exchange while at least a portion of said medium remains in a vapor phase.

(b) low pressure, two-phase medium flowing toward the compression stage being separated into its liquid and vapor phases, (c) said vapor phase being flowed to said compression stage, (d) said liquid phase being pressurized and subsequently atomized into the flowing vapor phase medium, and (e) said separated liquid phase medium being atomized and discharged back to said flowing medium at any one or more of the following locations upstream of the first heat exchange stage:

(i) upstream of the comression stage, (ii) downstream of the compression stage, (iii) during the compression stage.

2. A process for the operation of hybrid compression-absorption heat pumps or refrigerators, wherein there is circulated in a closed circuit a refrigerant medium comprising a plurality of differently volatile components dissolvable in each other and including the steps, in sequence, of compressing the refrigerant medium, passing the high pressure medium through a first external heat exchange, in which heat is extracted from the high pressure medium, thereafter causing expansion of the medium to lower pressure and conducting the expanded medium through a second external heat exchange in which heat is added to the medium, and returning the low pressure medium for compression, the improvement characterized by (a) so controlling and conducting the first heat exchange as to limit the condensation and dissolution of the high pressure multiple component medium so as to cause said medium to exit said first heat exchange while at least a portion of said medium remains in a vapor phase.

3. A process according to claim 2, further characterized by (a) passing the low pressure medium, emerging from the second heat exchange, in counter current internal heat exchange relation with the two-phase high pressure medium emerging from the first exchange whereby to effect further condensation and dissolution of vapors of the high pressure medium, and (b) thereafter routing the low pressure medium back to the compression stage.

4. The process of claim 3, further characterized by (a) said internal heat exchange being carried out in two stages, (b) in the first stage, high pressure, two-phase medium exiting from the first heat exchange being cooled substantially to complete the condensation and dissolution of vapors, (c) in the second such stage, the liquid phase, high pressure medium is further cooled, and (d) the low pressure medium being circulated first to said second stage internal heat exchange and thereafter to said first stage internal heat exchange.

5. A process according to any one of claims 2–4, further characterized by (a) low pressure, two-phase medium flowing toward the compression stage being separated into its liquid and vapor phases, the said vapor phase being flowed to said compression stage and (b) said liquid phase being pressurized and subsequently atomized into the flowing vapor phase medium.

6. A hybrid heat pump or refrigerator system which comprises (a) a compressor, (b) an external heat exchange device connected to the high pressure side of said compressor, (c) pressure reducing means connected to the discharge side of said heat exchange device, (d) a heat-absorbing external heat exchanger connected to the discharge side of said pressure reducer, (e) means connected to the discharge side of said heat-absorbing heat exchanger for flowing low pressure medium therefrom to said compressor, (f) separator means located between the outlet of said heat-absorbing heat exchanger and the inlet of said compressor for separating the low pressure medium into liquid and vapor phases, (g) means for pressurizing the separated liquid phase of said medium, and (h) means for atomizing said pressurized liquid phase medium and injecting said atomized medium into the flowing vapor phase medium to recombine the separated phases thereof.

7. The systemm of claim 6, further characterized by:

(a) said atomizing means being located in any one or more of the following locations: (i) upstream of said compressor, (ii) downstream of said compressor, and (iii) within said compressor, and (b) control means for controlling the flow of liquid medium through said respective atomizing means.

* * * * *